US005514021A

United States Patent [19]

Sugawara

[11] Patent Number: 5,514,021

[45] Date of Patent: May 7, 1996

[54] COIN SPINNER AND SAVINGS BOX WITH SAME

[75] Inventor: Shigeru Sugawara, Tokyo, Japan

[73] Assignee: Tenyo Co., Ltd., Japan

[21] Appl. No.: 398,677

[22] Filed: Mar. 6, 1995

[30] Foreign Application Priority Data

Apr. 22, 1994 [JP] Japan ..... 6-085033

[51] Int. Cl.[6] ..... A45C 1/12; A63H 1/00

[52] U.S. Cl. ..... 446/10; 446/236; 194/343

[58] Field of Search ..... 446/10, 11, 12, 446/13, 8, 9, 236, 246; 194/342, 343

[56] References Cited

U.S. PATENT DOCUMENTS

| | | | |
|---|---|---|---|
| 585,170 | 6/1897 | Archer | 446/13 X |
| 2,749,656 | 6/1956 | Reynolds | 446/8 |
| 3,696,992 | 10/1972 | Krone et al. | 446/8 X |
| 4,871,055 | 10/1989 | Poythress et al. | 446/8 X |
| 5,055,079 | 10/1991 | Hobson et al. | 446/8 |

FOREIGN PATENT DOCUMENTS

| | | | |
|---|---|---|---|
| 2591905 | 6/1987 | France | 446/236 |
| 5607 | 3/1884 | United Kingdom | 446/8 |
| 832103 | 4/1960 | United Kingdom | 446/9 |

*Primary Examiner*—Mickey Yu
*Assistant Examiner*—D. Neal Muir
*Attorney, Agent, or Firm*—Sixbey, Friedman, Leedom & Ferguson; Gerald J. Ferguson, Jr.; David S. Safran

[57] ABSTRACT

The present invention provides a coin spinner comprising a plate having a coin slit formed therein and in which a coin spinning mechanism consisting of a pair of leaf springs is encased. The plate is used with a savings box body having a coin receiver provided therein and also a transparent portion. Given a spinning force from the pair of leaf springs, a coin having been passed through the coin slit is spun on the coin receiver. The spinning coin is seen from outside the savings box body through the transparent portion.

7 Claims, 9 Drawing Sheets

COIN SPINNER AND SAVINGS BOX WITH SAME

BACKGROUND OF THE INVENTION

1. Field of the Invention

The present invention relates to a coin spinner by which a disc-like thing such as coin, medal or the like (will be generically referred to as "coin" hereinafter) is made to spin, and a savings box provided with the coin spinner and which gives a fun to see a coin dropped thereinto being spun.

2. Related-art Statement

Usually, a coin is spun mainly by hand. More particularly, the coin is held standing still on a tabletop or the like with fingers of one hand, and filliped at one end portion thereof with a finger of the other hand, to thereby spin the coin.

There has been proposed no savings box by which a coin dropped thereinto is made to spin and through which the spinning coin can be seen from outside.

SUMMARY OF THE INVENTION

The present invention has an object to provide a coin spinner which permits to spin a coin simply, positively and for a relatively long time, and a savings box provided with the coin spinner and which gives a fun to see a coin dropped thereinto being spun.

The above object can be accomplished by providing a coin spinner comprising, according to the present invention, a plate having formed therein a coin slit extending from the upper to lower side thereof, and a coin spinning mechanism provided on the lower side of the plate to impart a sufficient spinning force to a coin having been passed through the coin slit from the upper to lower side of the plate.

The above object can also be accomplished by providing a savings box comprising, according to the present invention, a hollow body having a coin slot formed in the upper portion thereof, a coin receiver provided inside the savings box body, a coin spinning mechanism provided as encased in the upper portion of the savings box body to impart to a coin dropped into the savings box body through the coin slot a sufficient spinning force to spin the coin on the coin receiver, and a transparent portion provided to the savings box body and through which the coin spinning on the coin receiver can be seen from outside the savings box body.

In the coin spinner according to the present invention, a coin passed from the upper to lower side of the plate is given a spinning force by the coin spinning mechanism. Thus, the coin can be spun more simply, positively and for a longer time than a coin spun by hand in the conventional manner as having been mentioned above.

In the savings box with the coin spinner, according to the present invention, a coin put from the coin slot into the savings box body is given a spinning force by the coin spinning mechanism, drops onto the coin receiver inside the savings box body and keeps spinning thereon. The coin spinning on the coin receiver is seen from outside the savings box body through the transparent portion thereof.

The present invention will be better understood from the ensuing description, given herebelow, of selected three preferred embodiments of the savings box with the coin spinner according to the present invention with reference to the drawings.

DETAILED DESCRIPTION OF THE PREFERRED EMBODIMENTS

FIGS. 1 through 12 show together the first embodiment of the savings box with the coin spinner according to the present invention. Note that FIGS. 2 through 5 show no coin centering member 7 provided as encased in a top lid portion 2 for easier understanding of the construction of the coin spinner according to the present invention.

Figure 1:
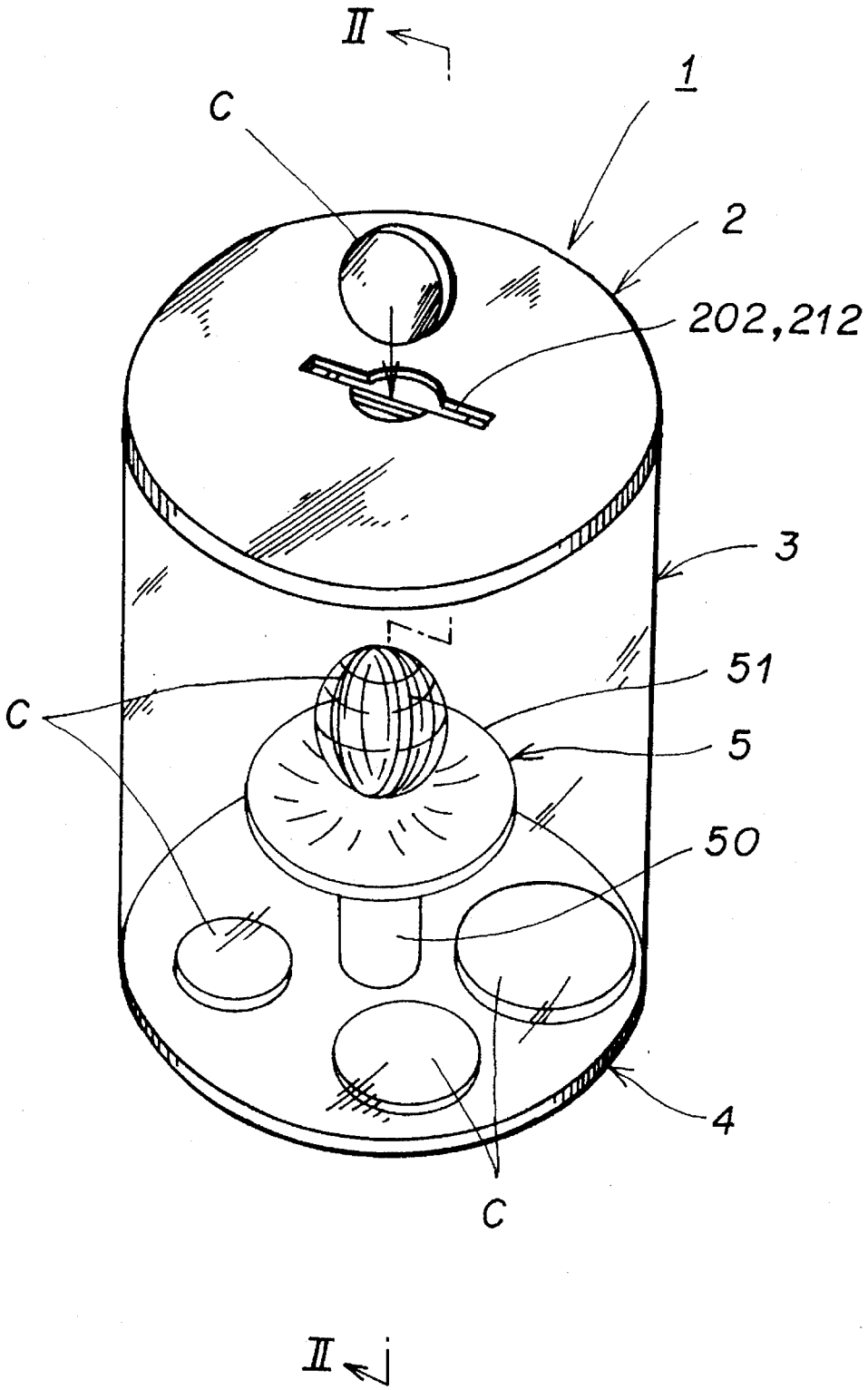
FIG. 1 is a perspective view of a first embodiment of the savings box provided with the coin spinner, according to the present invention.
Figure 2:
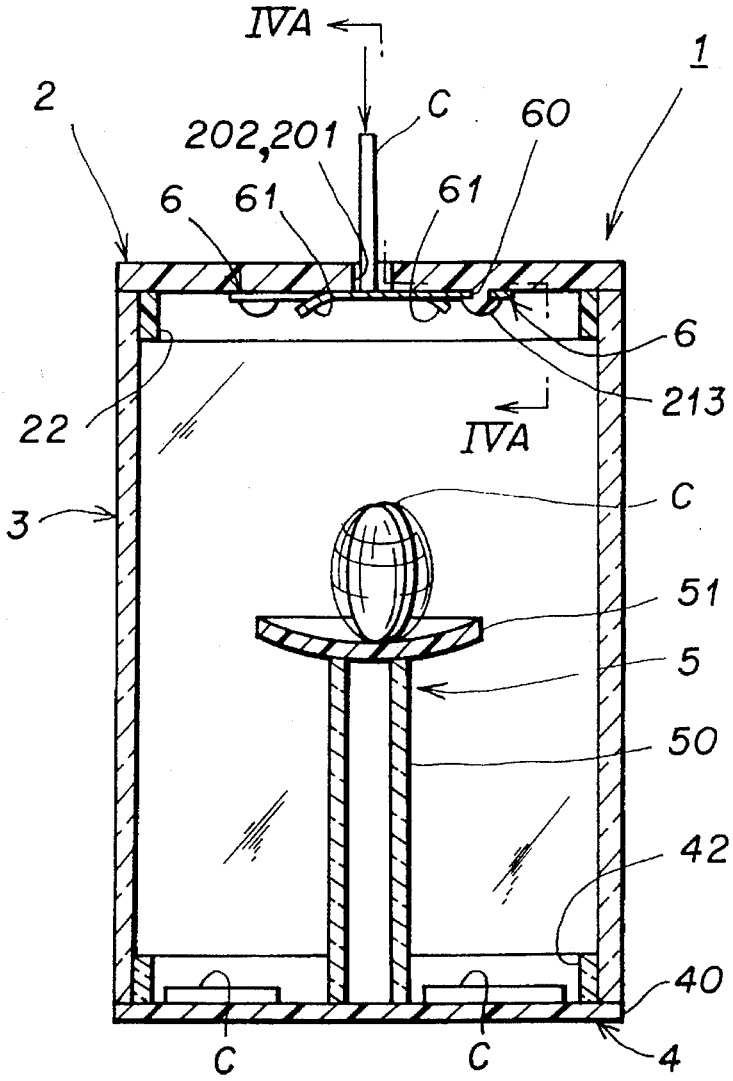
FIG. 2 is an axial-sectional view of the savings box, taken along the line II—II in FIG. 1.

The savings box according to the present invention comprises a body 1 consisting of the top lid portion 2 as the upper portion thereof, a barrel portion 3 and a bottom lid portion 4 as the lower portion as shown in FIGS. 1 and 2.

The above-mentioned top lid 2 is formed like a disc as seen from FIGS. 1 and 2, and made of an opaque material such as an opaque synthetic resin. The top lid 2 has a coin slit 202 (212) formed in the center thereof. In addition, the top lid 2 has fixed, with an adhesive or by ultrasonic welding, to the lower side thereof a short cylindrical member 22 made of an opaque material such as an opaque synthetic resin, in such a manner that the short cylinder 22 is centered with respect to the top lid 2.

The bottom lid 4 has also the form of a disc as also shown in FIGS. 1 and 2, and made of an opaque material such as an opaque synthetic resin. The bottom lid 4 has fixed, with an adhesive or by ultrasonic welding, to the upper side thereof a short cylindrical member 42 made of a transparent material such as a transparent synthetic resin, in such a manner that the short cylinder 42 is centered with respect to the bottom lid 4.

The above-mentioned barrel 3 has a cylindrical form as shown in FIGS. 1 and 2, and made of a transparent material such as a transparent synthetic resin. The short cylinder 22 of the top lid 2 and the short cylinder 42 of the bottom lid 4 are secured as fitted in the upper and lower openings, respectively, of the barrel 3. The top and bottom lids 2 and 4 may be removably attached to the barrel 3 or securely fixed to the barrel 3 with an adhesive or by ultrasonic welding.

Thus, the top lid 2, barrel 3 and bottom lid 4 form together the body 1 of the savings box that is hollow and has the coin slot 202 (212) formed in the upper portion thereof (top lid 2).

The barrel 3 is transparent so that a coin C spinning on a coin receiver 5 which will be further described later, is visible from outside through the barrel 3. In this embodiment, the barrel 3 is entirely transparent. However, it may be partially transparent.

It should be noted that in case the top and bottom lids 2 and 4 are fixed directly to the upper and lower end faces, respectively, of the barrel 3, the short cylinders 22 and 42 are not always necessary. Further, the bottom lid 4 is made of the opaque synthetic resin in this embodiment; however, it may be made of a transparent material such as a transparent synthetic resin. Moreover, the short cylinder 42 of the bottom lid 4 is made of the transparent synthetic resin; however, it may be made of an opaque material such as an opaque synthetic resin.

As seen from FIGS. I and 2, there is provided in the savings box body 1 the coin receiver 5 consisting of a support column portion 50 and a receiving disc portion 51. The support column portion 50 is a hollow cylinder made of a transparent material such as a transparent synthetic resin. The support column 50 is fixed at the lower end thereof, with an adhesive or by ultrasonic welding, concentrically to the upper side of the bottom lid 4.

The coin receiving disc 51 is a disc of which the upper side is spherically concave, and made of an opaque material such as an opaque synthetic resin. The receiving disc 51 is metal-plated on at least the upper side (spherically concave side) thereof. The disc 51 is fixed at the lower side thereof, with an adhesive or by ultrasonic welding, concentrically to the upper end of the column 50. Thus, the support column 5 of the coin receiver 5 stands upright from the bottom lid 4 and the coin receiving disc 51 faces the coin slit 212 (202).

The support column 50 is made of the transparent synthetic resin in this embodiment; however, it may be made of an opaque material such as an opaque synthetic resin. Also, the coin receiving disc 51 is made of the opaque synthetic resin in this embodiment; however, it may be made of a transparent material such as a transparent synthetic resin. Moreover, the receiving disc 51 may not necessarily be metal-plated. Alternatively, the receiving disc 51 may be metal-plated on all the sides thereof.

As shown in FIGS. 2 through 5, the above-mentioned top lid 2 has provided on the inner (lower) side thereof a pair of leaf springs 6 which impart a spinning force to the coin C when passing through between them. These leaf springs 6 are provided to impart to the coin C introduced through the coin slits 202 (212) into the savings box body 1 a sufficient spinning force to spin the coin C on the coin receiving disc 51. Each of the leaf springs 6 in pair is made of, for example, an elongated strip of a spring steel.

As seen from FIG. 5(A), the leaf springs 6 in pair are generally parallel to each other and so disposed as to intersect the coin slit 202 (212) obliquely. The leaf springs 6 are fixed to the lower side of the top lid 2 as staggered across the longer edges of the coin slit 202 (212), more particularly one of the springs 6 is fixed at this side, and the other is at that side, of the coin slit 202 (212). The leaf springs 6 in pair may be fixed to the top lid 2 by a heat-caulking, for example. More specifically, a small projection 213 formed on the top lid 2 is inserted into a through-hole 60 formed in the end portion of the leaf spring 6, and the leaf spring 6 is fixed to the top lid 2 by heat-caulking of the end portion of the small projection 213. Note that the free end portions 61 of the leaf springs 6 in pair, opposite to the fixed end portions, are bent, respectively.

The above-mentioned leaf springs 6 are made of a spring steel in this embodiment; however, they may be made of any other elastic material such as a highly rigid synthetic resin. Also, in place of the above-mentioned heat-caulking, screwing, bonding or pinchcocking may be adopted to securely fix the springs 6 to the top lid 2. Alternatively, in case the leaf springs 6 are made of the synthetic resin as mentioned above, they may be molded integrally with the top lid 2.

Figure 6:
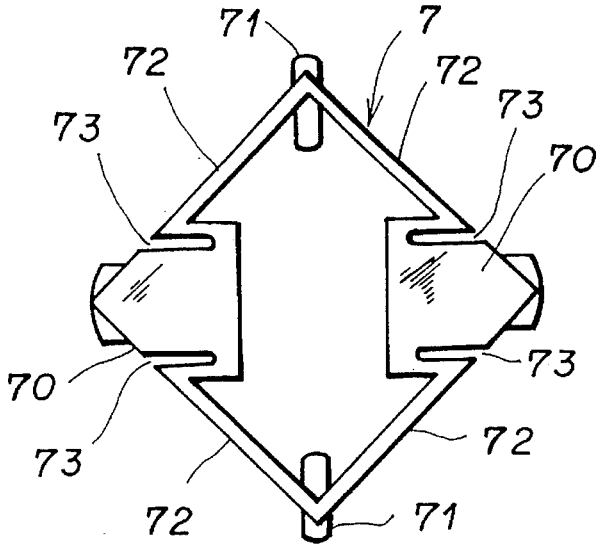
FIG. 6 is a plan view of the coin centering member.

As shown in FIGS. 6 through 9, the above-mentioned top lid 2 has the coin centering member 7 provided as encased therein. The coin centering member 7 is provided to center a coin C introduced into the coin slit 202 (212) to between the leaf springs 6 in pair. The coin centering member 7 is made of an elastic material such as a synthetic resin, and composed, as shown in FIG. 6, of four coupling arms 72 shaped correspondingly to four sides of a square (regular square in this embodiment), a pair of sliding portions 71 formed integrally with the coupling arms 72 and diagonally disposed at two opposite angles, respectively, of the square, and a pair of coin holders 70 diagonally disposed at other two angles, respectively, of the square. Each of the pair of coin holders 70 has a cut 73 formed on either side thereof. These cuts 73 impart a flexibility to the coupling arms 72.

Further, as shown in FIGS. 7 through 10, the coin centering member 7 is encased in a circular concavity 200 formed in the top lid 2. The above-mentioned sliders 71 in pair are slidably engaged in a first guide recess 211 formed in the top lid 2 perpendicularly to .the coin slit 202 (212) and extending through the center between the leaf springs 6 in pair. Moreover, the coin holders 70 in pair are slidably engaged at the respective base portions thereof in a second guide recess 210 formed in the top lid 2 longitudinally of the coin slit 202 (212). Thus, a coin C passing through the slit 202 (212) is so held at the circumference thereof from either end by the pair of coin holders 70 cooperating with the pair of sliders 71 and coupling arms 72 as to be centered to between the leaf springs 6 in pair.

Figure 9:
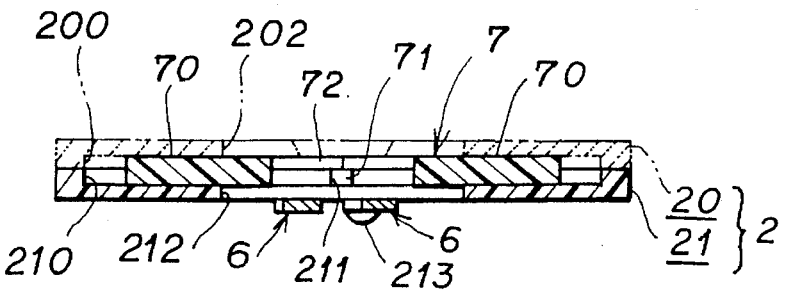
FIG. 9 is a sectional view of the top lid, taken along the line IX—IX in FIG. 7.
Figure 10:
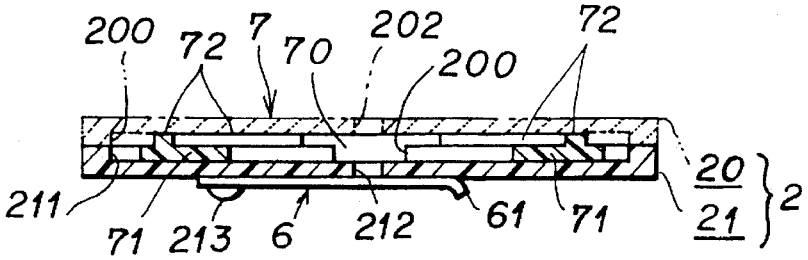
FIG. 10 is a sectional view of the top lid, taken along the line X—X in FIG. 7.
Figure 11:
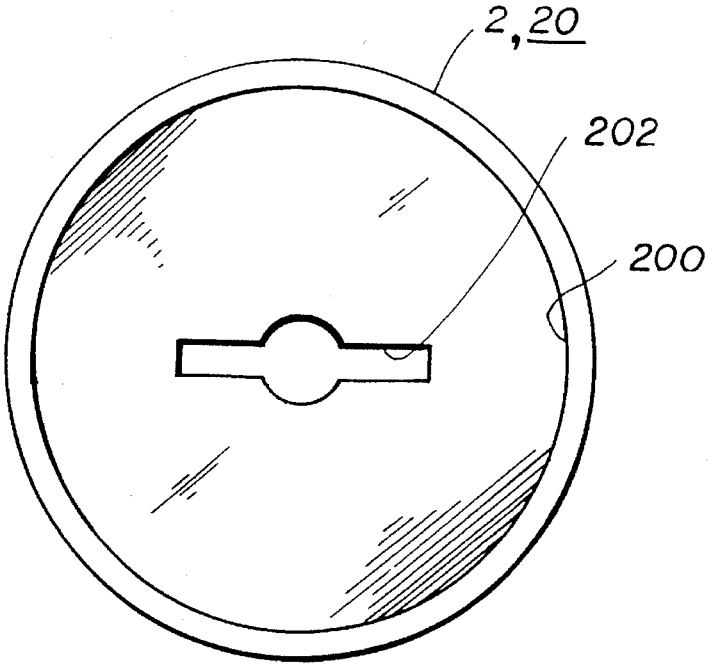
FIG. 11 is a bottom view of the upper portion of the top lid.
Figure 12:
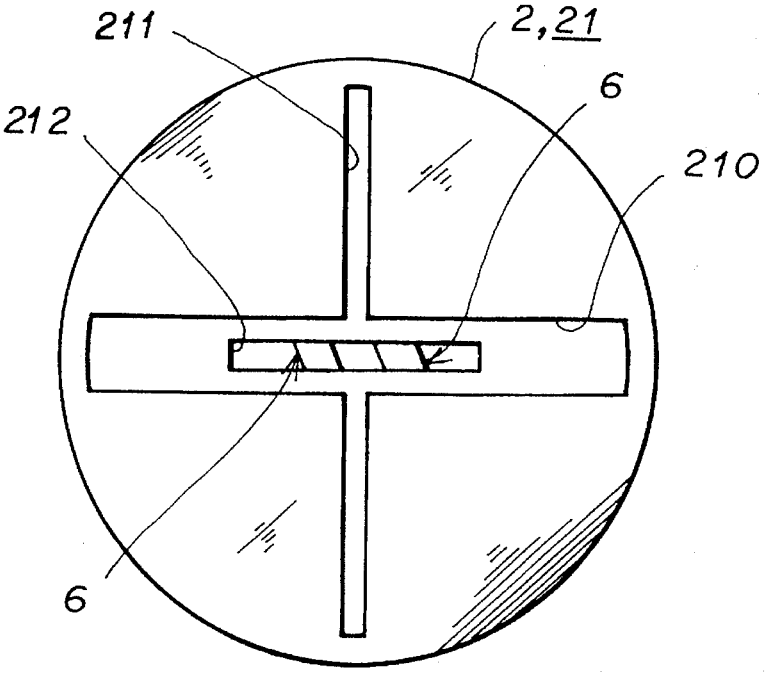
FIG. 12 is a plan view of a lower portion of the top lid.

The construction of the coin centering member 7 encased in the concavity 200 in the top lid 2 will be described in further detail with reference to FIGS. 7 through 12. First, the top lid 2 consists of the upper portion 20 and lower portion 21 as shown in FIGS. 9 and 10. As seen from FIG. 11, the upper portion 20 has formed in the center thereof the coin slit 202 of which the central portion 201 is a circular opening, and also has formed therein the circular concavity 200 in which the above-mentioned coin centering member 7 is encased. As shown in FIG. 12, the lower portion 21 of the upper lid 2 has the coin slit 212 formed in the center thereof. Also it has formed in the upper side thereof the first guide recess 211 extending perpendicularly to the coin slit 212 and through the center between the leaf springs 6 in pair, and in the lower side thereof the second guide recess 210 extending longitudinally of the coin slit 212. The above-mentioned pair of sliders 71 and pair of coin holders 70 are slidably engaged in the first and second guide recesses 211 and 210, respectively. By fixing the lower side of the upper portion 20 to the upper side of the lower portion 21 with an adhesive or by ultrasonic welding, the coin centering member 7 disposed in the circular concavity 200 in the upper portion 20 is encased in the upper lid 2.

The top lid 2 (comprising the upper and lower portions 20 and 21 and the short cylinder 22) is made of an opaque synthetic resin in this embodiment; however, it may be made of a transparent material such as a transparent synthetic resin unless it is necessary to conceal the coin spinning mechanism (leaf springs 6) and coin centering member 7.

The savings box with the coin spinner according to the first embodiment of the present invention is constructed as having been described in the foregoing. It is to be used as will be explained herebelow.

Figure 3:
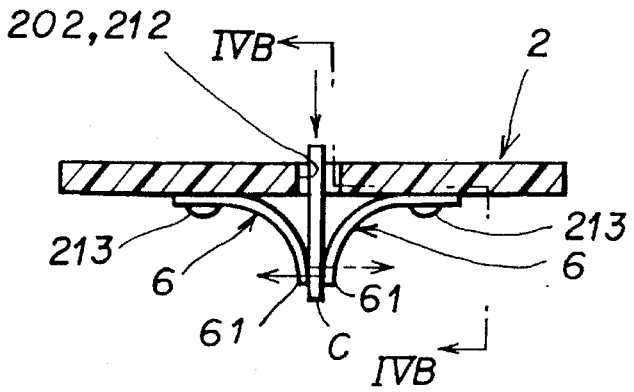
FIG. 3 is a sectional view of the top lid, showing a pair of leaf springs deflected by a coin introduced into the coin slit.
Figure 4:
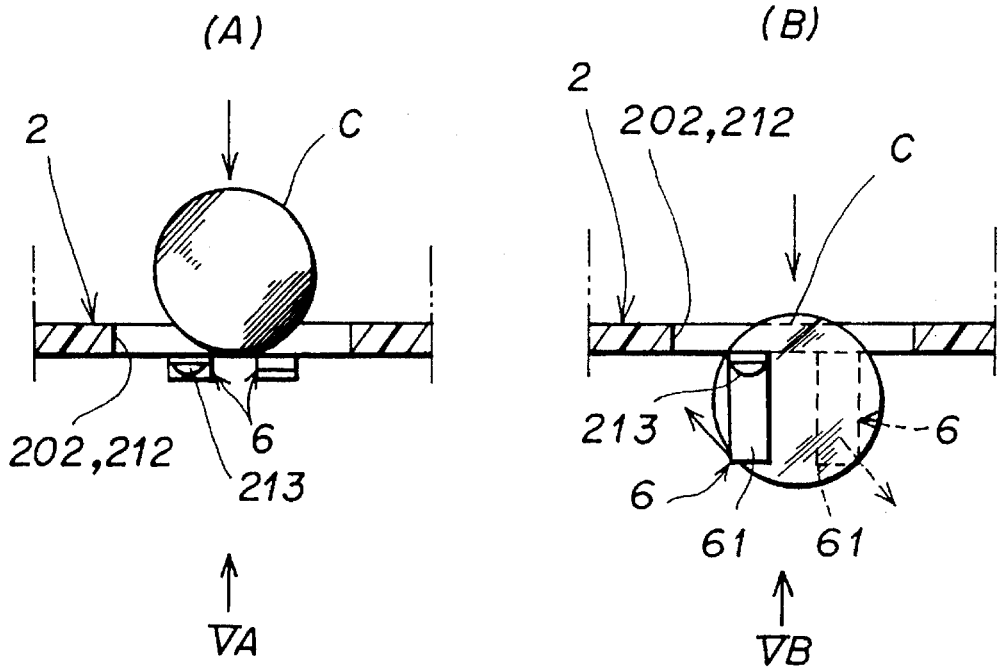
FIG. 4(A) is a sectional view of the top lid, taken along the line IVA—IVA in FIG. 2.
FIG. 4(B) is a sectional view of the top lid, taken along the line IVB—IVB in FIG. 3.
Figure 5:
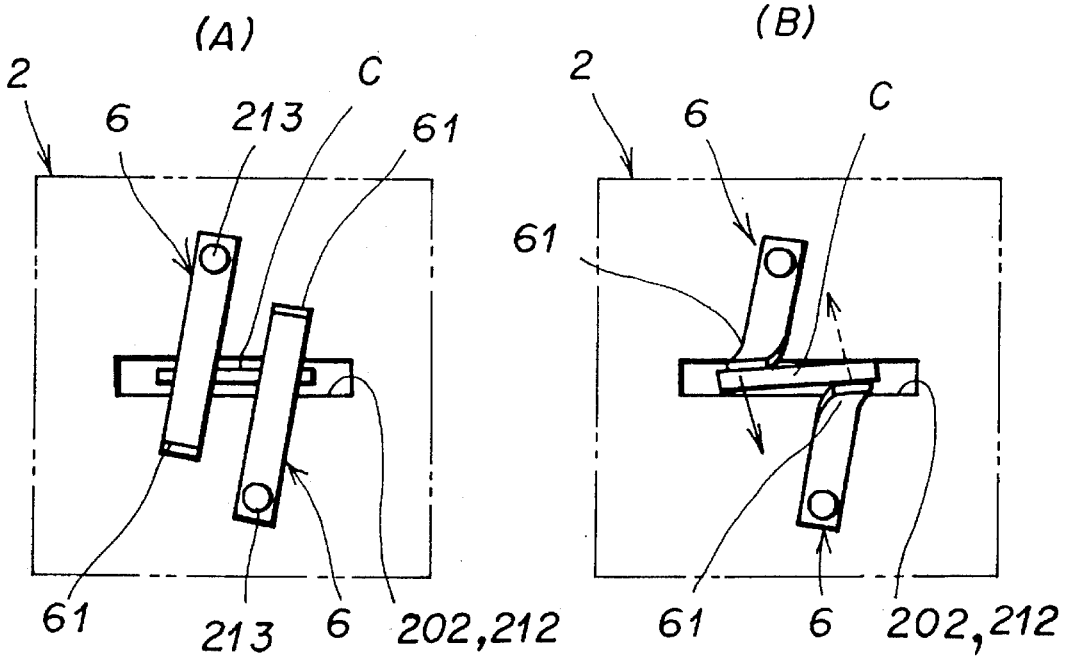
FIG. 5(A) is a view of the coin spinner from a viewpoint VA in FIG. 4(A)
FIG. 5(B) is a view of the coin spinner from a viewpoint VB in FIG. 4(B)

First, a coin C is put in the coin slit 202 (212) and introduced into the savings box body 1 against the force of the pair of leaf springs 6. As shown in FIGS. 3, 4(A) and 5(B), the coin C thus pressed will come to between the leaf springs 6 in pair to deflect nearly vertically the free end portions 61 of the leaf springs 6. At this time, the deflected free end portions 61 abut both sides, respectively, of the coin C under their respective resiliences working in the opposite directions. Also, the coin C stands still since it is forced to the lateral edges of the coin slit 202 (212).

The coin C is further pressed from the above position to pass through the coin slit 202 (212). The coin C leaves the lateral edges of the coin slit 202 (212) and is given at the opposite sides thereof the abovementioned resiliences of the leaf springs 6 in pair that will go back toward their respective initial positions, that is, in the opposite directions. Thus, the coin C is spun. As shown in FIGS. I and 2, the coin C falls onto the coin receiving disc 51 of the coin receiver 5 inside the savings box body 1 and keeps spinning thereon. The coin C spinning on the receiving disc 51 is visible from outside the savings box body 1 through the transparent barrel 3.

Especially in this embodiment, the coin centering member 7 is provided to center the coin C passing through the coin slit 202 (212) to between the leaf springs 6 in pair. Namely, the coin C passing through the coin slit 202 (212) comes to between the coin holders 70 in pair which in turn will be slid outwardly (in the directions indicated with the solid-line arrows). As the coin holders 70 are slid outwardly, the cuts 73 in either side of the coin holders 70 are opened, the four coupling arms 72 are deflected and the sliders 71 in pair are made by means of the coupling arms 72 to slide inwardly (in the directions indicated with the solid-line arrows). Since the sliding direction of the pair of coin holders 70 and that of the pair of sliders 71 correspond to the diagonal lines, respectively, of the square of which the four sides are the coupling arms 72, the coin holders 70 in pair will make an equidistant outward sliding. Thus, the coin C is so held at the circumference thereof from either end by the coin holders 70 as to be centered to between the leaf springs 6 in pair.

Figure 7:
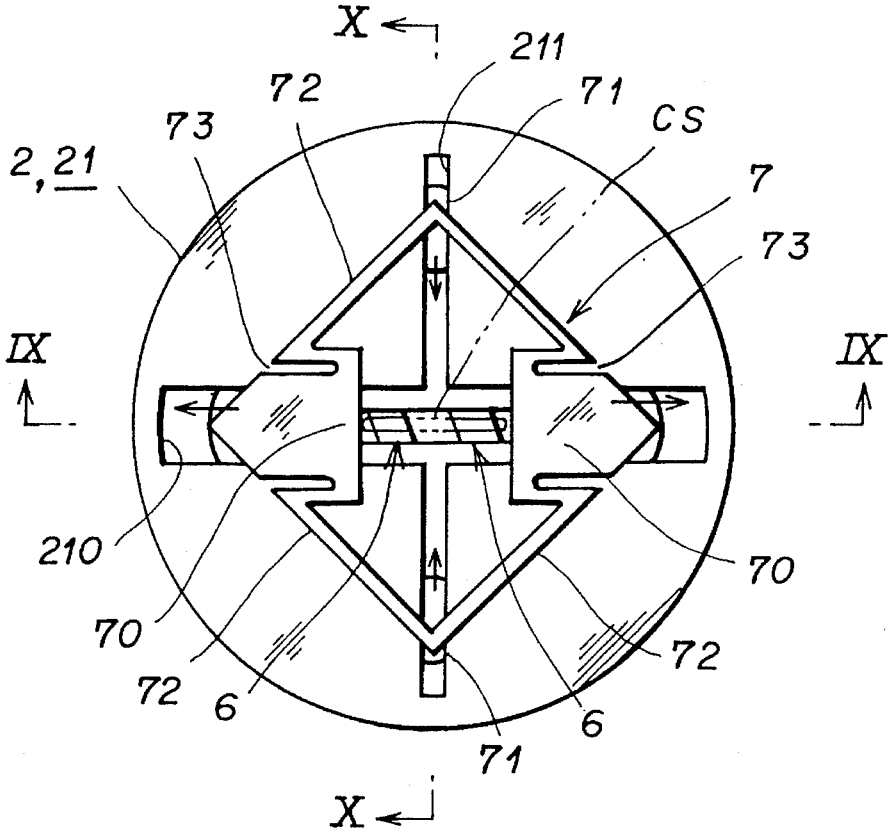
FIG. 7 is a plan view of the top lid with the upper portion thereof removed, showing the action of the coin centering member when a small-diameter coin is introduced into the coin slit.
Figure 8:
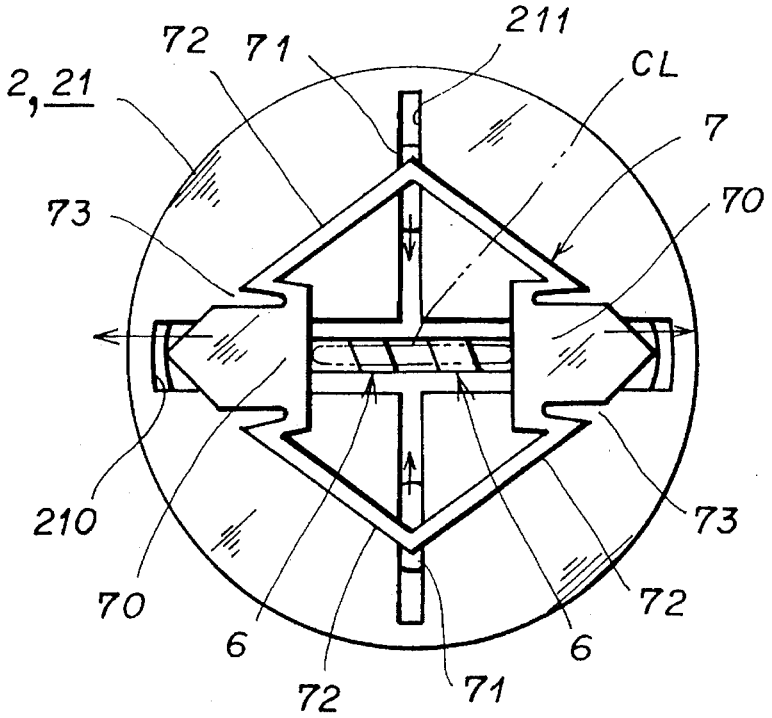
FIG. 8 is a plan view of the top lid, showing the action of the coin centering member when a large-diameter coin is introduced into the coin slit.

The coin centering member 7 works also effectively with coins of different diameters. When a coin CS having a smaller diameter is put into the savings box body 1, the outward sliding distance of the pair of coin holders 70 is shorter as shown in FIG. 7. Alternatively, when a coin CL having a larger diameter is put into the savings box body 1, the coin holders 70 in pair will be slid outwardly over a longer distance. Namely, any coin C can be centered to between the leaf springs 6 in pair whether its diameter is smaller or larger.

The centering of the coin C to between the springs 6 in pair allows to impart a same resilience to both sides of the coin C from the pair of leaf springs 6, so the coin C can be spun positively and for a longer time.

After the coin C has passed through between the coin holders 70 in pair, the above-mentioned coupling arms 72 will return to their initial positions from the deflected ones, so that the pair of coin holders 70 will slid back to their initial positions inwardly (in the opposite directions to those indicated with the solid-line arrows) and also the pair of sliders 71 will do so outwardly (in the opposite directions to those indicated with the solid-line arrows).

Note that the coin centering member 7 may not necessarily be provided.

Figure 13:
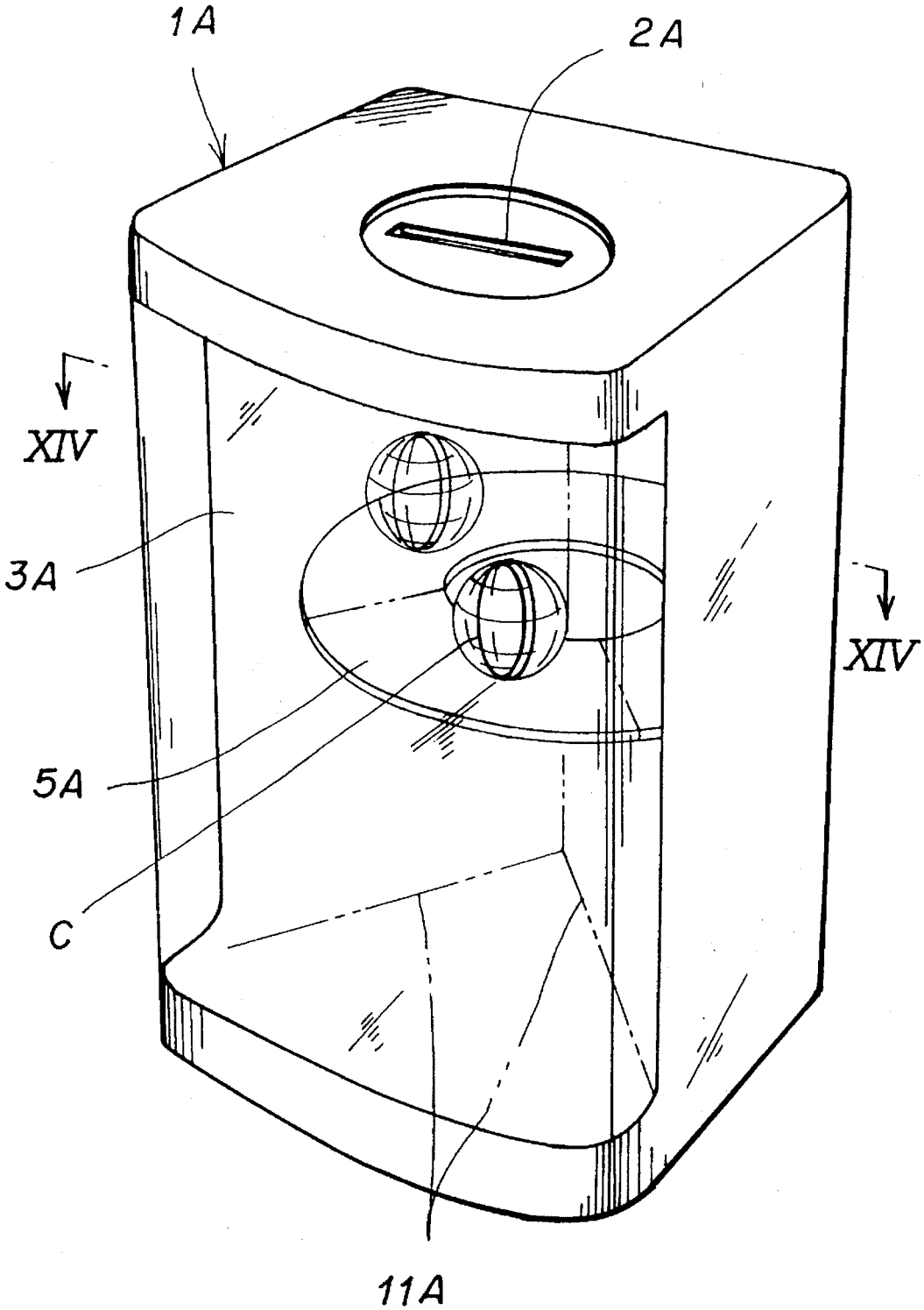
FIG. 13 is a perspective view of a second embodiment of the savings box with the coin spinner, according to the present invention.
Figure 14:
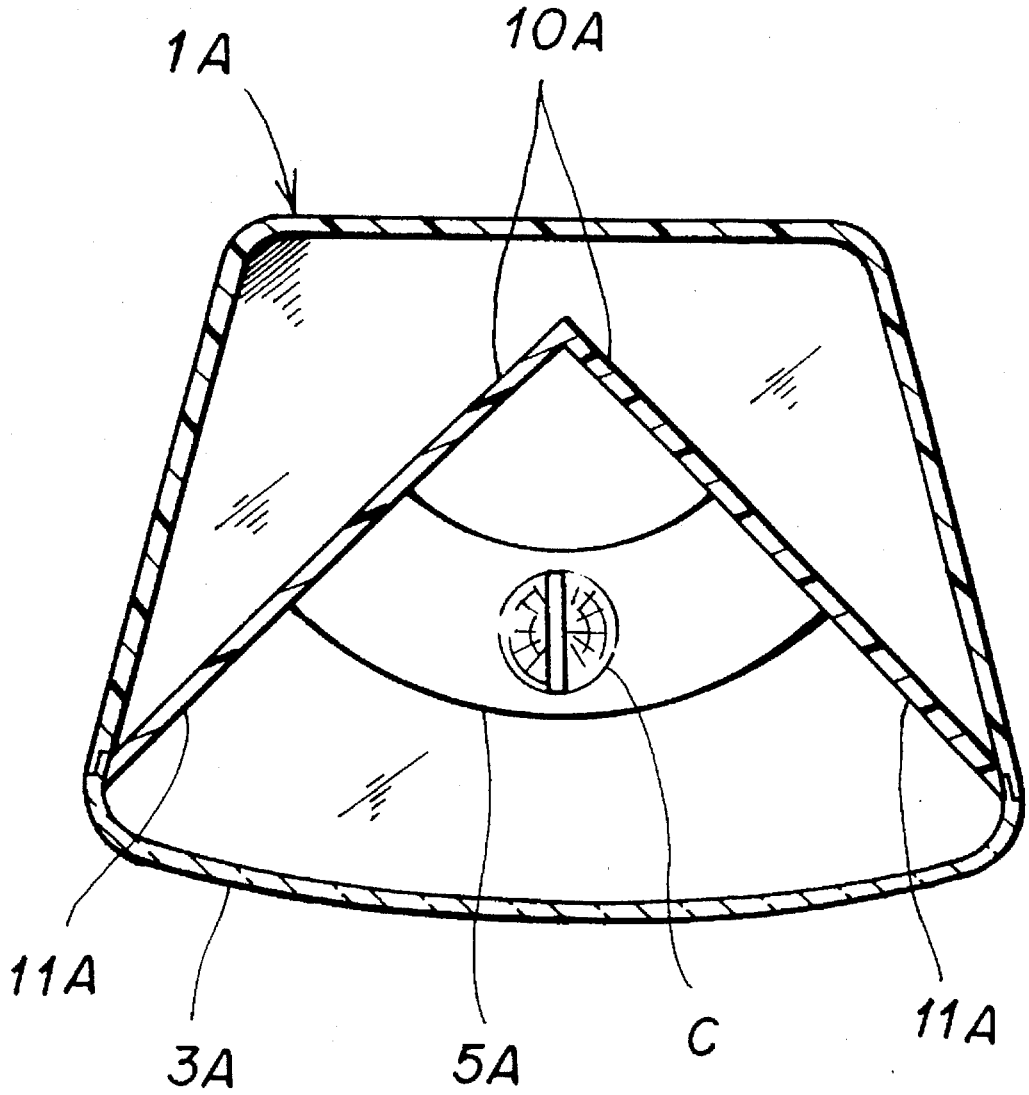
FIG. 14 is a cross-sectional view of the savings box, taken along the line XIV—XIV in FIG. 13.

FIGS. 13 and 14 show together the second embodiment of the savings box with the coin spinner according to the present invention.

The savings box according to the second embodiment of the present invention comprises a hollow body 1A formed generally like a rectangular parallelepiped and having a coin slit 2A formed in the upper portion thereof, a circular arc-like coin receiver 5A disposed inside the savings box body 1A, a coin spinning mechanism (not shown) encased in the upper portion of the savings box body 1A, and a transparent portion 3A provided over the front opening of the savings box body 1A. The savings box body 1A has disposed therein a partition wall 10A of which the cross section has an "L-shape". The partition wall 10A has a mirror 11A attached on the surface thereof opposite to the transparent portion 3A. The mirror 11A has the above-mentioned circular arc-like coin receiver 5A fixed thereto.

Because of the above-mentioned construction, a coin C put into the savings box body 1A through the coin slit 2A is spun by the coin spinning mechanism and keeps spinning on the coin receiver 5A. When the coin C spinning on the coin receiver 5A is viewed from outside through the transparent portion 3A, the reflection by the mirror 11A will provide an illusion that more than one coin C are spinning on the coin receiver 5A looking like a ring.

Figure 15:
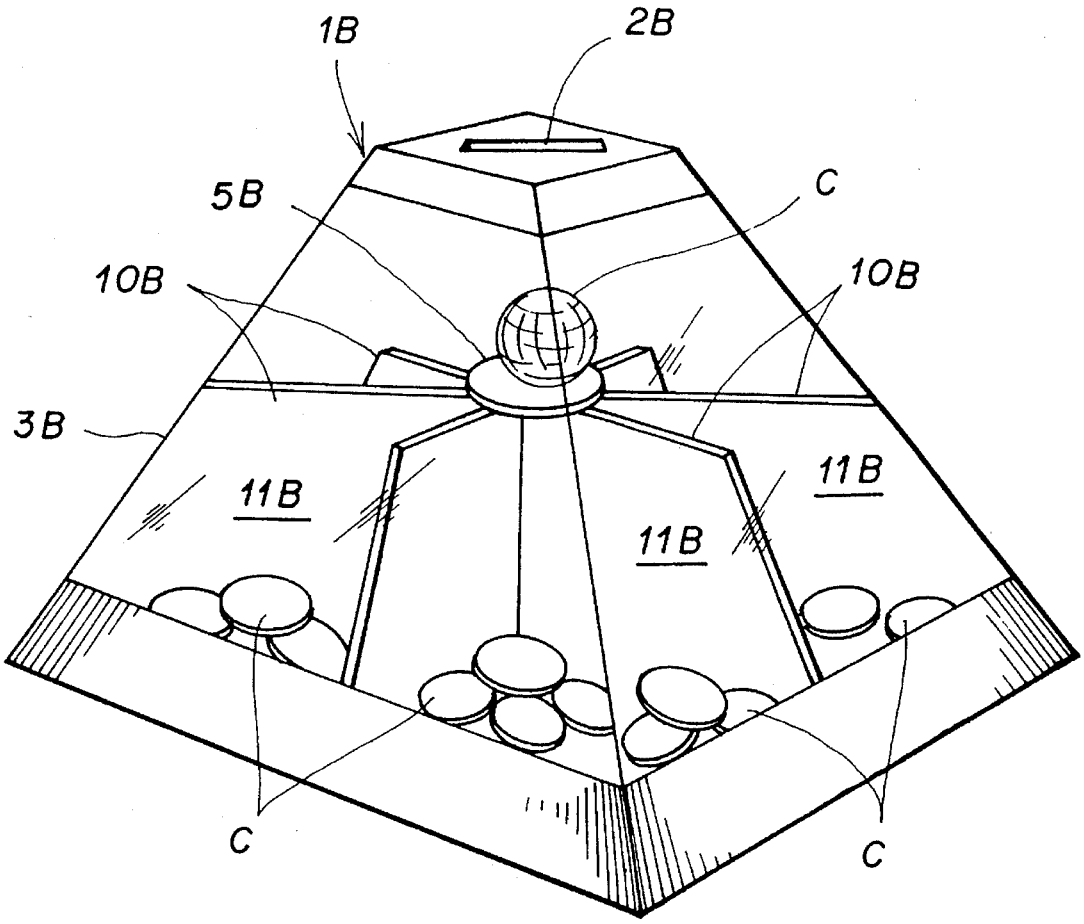
FIG. 15 is a perspective view of a third embodiment of the savings box with the coin spinner, according to the present invention.

FIG. 15 shows the third embodiment of the savings box with the coin spinner according to the present invention.

The savings box according to the second embodiment of the present invention comprises a hollow body 1B formed generally like a truncated pyramid and having a coin slit 2B formed in the upper portion thereof, a coin receiver 5B disposed inside the savings box body 1B, a coin spinning mechanism (not shown) encased in the upper portion of the savings box body 1, and transparent portions 3B provided on the four sides of the savings box body 1B. The savings box body 1B has a plurality (eight in this embodiment) of compartments 11B resulted from partitioning of the lower half space of the savings box body.1B by radial partition walls 10B. The coin receiver 5B is fixed to the center of the radial partition walls 10B.

Because of the above-mentioned construction, a coin C put into the savings box body 1B through the coin slit 2B is spun by the coin spinning mechanism and keeps spinning on the coin receiver 5B. The coin C stopped from spinning will fall into any one of the compartments 11B from on the coin receiver 5B. The spinning and falling of the coin C are visible from outside through the transparent portion 3B.

This embodiment of the savings box can also be used as follows. For example, eight different kinds of fortunetelling words are assigned to the eight compartments 11B, respectively. The words assigned to any one of the compartments 11B into which the coin C has fallen will tell a fortune for the day.

The embodiments of the present invention have been described as savings box with the coin spinner in the foregoing. However, the coin spinner according to the present invention may be used for any purposes other than savings. For instance, it may be used in a toss-like play. A coin is spun by the coin spinner to see which side (head or tail) is on top when it finally falls. The savings box with the coin spinner may be used in a backgammon-like game. For this game, an arrow or the like is marked on either side of a coin, the circumferential area of the coin receiver 5 is regularly divided into blocks in which numbers for moving the piece or man are marked. When the coin falls and the arrow mark on any side thereof points a block, the man can be moved the number of steps marked in that block.

The coin spinner according to the present invention may not be used with a savings box, but only the top lid 2 (provided with the pair of leaf springs 6) may of course be used simply as a coin spinner.

What is claimed is:

1. A coin spinner, comprising:

a plate having upper and lower surfaces, and having formed therein a coin slit; and a coin spinning mechanism provided on the lower surface of said plate to impart a spinning force to a coin having been passed through said coin slit from the upper surface to the lower surface of said plate which rotates the .coin about a vertical axis during its natural falling, comprising a pair of leaf springs disposed substantially parallel to each other and intersecting said coin slit obliquely, one end of each leaf spring being fixed, the fixed ends of the leaf springs being at locations opposite to each other across said coin slit.

2. A coin spinner as set forth in claim 1, wherein said plate is provided as encased therein with a coin centering member having the general form of a square, comprising:

coupling arm portions corresponding to four sides of the square;

a pair of sliding portions formed integrally with said coupling arm portions and diagonally disposed at two opposite angles, respectively, of the square, said sliding portions being slidable perpendicularly to said coin slit centrally between said leaf springs in pair; and a pair of coin holders diagonally disposed at other two angles, respectively, of the square, said coin holders being slidable longitudinally of the coin slit and cooperating with said pair of sliding portions and coupling arm portions to hold from either end the circumference of a coin passing through said coin slit, thereby centering the coin to between said leaf springs in pair.

3. A coin spinner as set forth in claim 2, wherein said coin centering member is encased in said plate.

4. A savings box, comprising:

a hollow box body having an upper portion, lower portion and side portion connecting the upper and lower portions;

a coin slit formed in the upper portion of said box body;

a coin receiver provided inside said box body;

a coin spinning mechanism provided on an inner surface of the upper portion to impart to a coin having been passed through said coin slit a spinning force to spin the coin on said coin receiver about a vertical axis, comprising a pair of leaf springs disposed substantially parallel to each other and intersecting said coin slit obliquely, one end of each leaf spring being fixed, the fixed ends of the leaf springs being at locations opposite to each other across said coin slit; and a transparent portion provided to said box body and through which the coin spinning on said coin receiver can be seen from outside said box body.

5. A savings box as set forth in claim 4, wherein said coin receiver stands upright from a lower portion of said savings box body and is opposite to said coin slit.

6. A savings box as set forth in claim 4, wherein the upper portion of said hollow body is provided with a coin centering member having the general form of a square, comprising:

coupling arm portions corresponding to four sides of the square;

a pair of sliding portions formed integrally with said coupling arm portions and diagonally disposed at two opposite angles, respectively, of the square, said sliding portions being slidable perpendicularly to said coin slit centrally between said leaf springs in pair; and a pair of coin holders diagonally disposed at other two angles, respectively, of the square, said coin holders being slidable longitudinally of said coin slit and cooperating with said pair of sliding portions and coupling arm portions to hold from either end the circumference of the coin passing through said coin slit, thereby centering the coin to between said leaf springs in pair.

7. A savings box as set forth in claim 6, wherein said coin centering member is encased in the upper portion of said hollow body.

* * * * *